US012312913B2

(12) United States Patent
Sisak et al.

(10) Patent No.: US 12,312,913 B2
(45) Date of Patent: May 27, 2025

(54) POSITIONAL-RELEASE MECHANISM FOR A DOWNHOLE TOOL

(71) Applicant: Schlumberger Technology Corporation, Sugar Land, TX (US)

(72) Inventors: William Ryan Sisak, Houston, TX (US); Bo Chen, Rosharon, TX (US); Brian Walther, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/694,517

(22) PCT Filed: Oct. 21, 2022

(86) PCT No.: PCT/US2022/047385

§ 371 (c)(1),
(2) Date: Mar. 22, 2024

(87) PCT Pub. No.: WO2023/081023

PCT Pub. Date: May 11, 2023

(65) Prior Publication Data

US 2024/0401434 A1 Dec. 5, 2024

Related U.S. Application Data

(60) Provisional application No. 63/274,655, filed on Nov. 2, 2021.

(51) Int. Cl.
*E21B 34/14* (2006.01)

(52) U.S. Cl.
CPC ..... *E21B 34/14* (2013.01)

(58) Field of Classification Search
CPC ..... E21B 34/14
See application file for complete search history.

(56) References Cited

U.S. PATENT DOCUMENTS

| | | | | |
|---|---|---|---|---|
| 2012/0067583 | A1* | 3/2012 | Zimmerman | E21B 43/26 166/308.1 |
| 2012/0067595 | A1 | 3/2012 | Noske et al. | |
| 2012/0312555 | A1 | 12/2012 | Caminari et al. | |
| 2013/0312960 | A1 | 11/2013 | Jasek et al. | |
| 2015/0041130 | A1 | 2/2015 | Cleveland et al. | |
| 2015/0211332 | A1 | 7/2015 | Noske et al. | |
| 2015/0218916 | A1* | 8/2015 | Richards | E21B 34/14 166/278 |

* cited by examiner

*Primary Examiner* — Dany E Akakpo
(74) *Attorney, Agent, or Firm* — Jeffrey D. Frantz

(57) ABSTRACT

A shifting tool for use with an isolation valve. The shifting tool may include a mandrel and a first shifting assembly positioned about the mandrel. The first shifting assembly may include a shifting member engageable with a profile of the isolation valve to shift the isolation valve into at least one of an open position or a closed position, a sleeve engageable with the shifting member to prevent disengagement between the shifting member and the isolation valve, and a detent mechanism engageable with the shifting member to prevent disengagement between the sleeve and the shifting member. The detent mechanism may engage with the shifting member when the shifting tool initially engages with an isolation valve and relative movement of the shifting tool with respect to the isolation valve may disengage the detent mechanism from the shifting member when the detent mechanism reaches predetermined location within isolation valve.

15 Claims, 7 Drawing Sheets

POSITIONAL-RELEASE MECHANISM FOR A DOWNHOLE TOOL

CROSS-REFERENCE TO RELATED APPLICATIONS

This application is a National Stage Entry of International Application No. PCT/US2022/047385, filed Oct. 21, 2022, which claims the benefit of U.S. Provisional Application No. 63/274,655 entitled "Positional-Release Mechanism for a Downhole Tool," filed Nov. 2, 2021, the disclosure of which is incorporated herein by reference in its entirety.

BACKGROUND

An isolation valve is a device that provides isolation to a reservoir. Specifically, a formation isolation valve is downhole completion equipment that is used to provide two-way isolation from the formation. This double isolation allows the performance of completion operations without placing a column of heavy fluid in the wellbore to prevent the production of reservoir fluids.

Although the main purpose of a formation isolation valve is formation isolation, the versatility of the formation isolation valve may be seen in a broad range of applications including prevention of fluid loss, packer setting, and lateral isolation. The failure of an isolation valve to shift open or closed can be deemed catastrophic and cause the Operator a great deal of expense. If the shifting tool fails, it must be pulled out of hole and an alternate opening and/or closing method must be employed. Accordingly, there is a need for a robust and reliable shifting tool.

SUMMARY

According to one or more embodiments of the present disclosure, shifting tool for use with an isolation valve includes a mandrel and a shifting assembly positioned about the mandrel and including shifting member, a sleeve, and a detent mechanism. The shifting member is engageable with a profile of the isolation valve to shift the isolation valve into at least one of an open position or a closed position. The is sleeve engageable with the shifting member to prevent disengagement between the shifting member and the isolation valve. The detent mechanism is engageable with the shifting member to prevent disengagement between the sleeve and the shifting member. The detent mechanism engages with the shifting member when the shifting tool initially engages with an isolation valve and relative movement of the shifting tool with respect to the isolation valve disengages the detent mechanism from the shifting member when the detent mechanism reaches predetermined location within isolation valve.

According to one or more embodiments of the present disclosure, a completion system for use within a wellbore includes an isolation valve and a shifting tool positionable within the wellbore and engageable with the isolation valve. The isolation valve includes an internal profile, the isolation valve positionable within the wellbore and shiftable between an open position and a closed position. The shifting tool includes a mandrel and a shifting assembly positioned about the mandrel and including a shifting member, a sleeve, and a detent mechanism. The shifting member is engageable with the internal profile to shift the isolation valve into at least one of the open position or the closed position. The is sleeve engageable with the shifting member to prevent disengagement between the shifting member and the isolation valve. The detent mechanism is engageable with the shifting member to prevent disengagement between the sleeve and the shifting member. The detent mechanism engages with the shifting member when the shifting tool initially engages with an isolation valve and relative movement of the shifting tool with respect to the isolation valve disengages the detent mechanism from the shifting member when the detent mechanism reaches predetermined location within isolation valve.

According to one or more embodiments of the present disclosure, a method of producing hydrocarbons from a well includes running a well string comprising an isolation valve into the well. The method also engaging a shifting tool with the isolation valve, thereby engaging a detent mechanism of the shifting tool with a shifting member of the shifting tool and engaging the first shifting member of the shifting tool with the isolation valve. The method also includes applying a force to the isolation valve via the shifting tool to shift the isolation valve to an open position or a closed position.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point at the surface from which drilling operations are initiated as being the top point and the total depth being the lowest point, wherein the well (e.g., wellbore, borehole) is vertical, horizontal, or slanted relative to the surface.

The present disclosure generally relates to systems and methods that facilitate actuation of an isolation valve or other downhole device. According to one or more embodiments of the present disclosure, an isolation valve includes an isolation valve member, e.g., a ball valve element, which may be actuated between positions. For example, the isolation valve member may be actuated between closed and open positions by a mechanical section having a shifting linkage.

In one or more embodiments of the present disclosure, actuation of the mechanical section, and thus actuation of the isolation valve member, is achieved by a shifting tool. Additionally, although the shifting tool is described in relation to an isolation valve, the invention is not thereby limited. The shifting tool may be used to actuate any type of downhole tool, for example, but not limited to, a ball valve, a sleeve valve, a flapper valve, or a packer.

Figure 1:
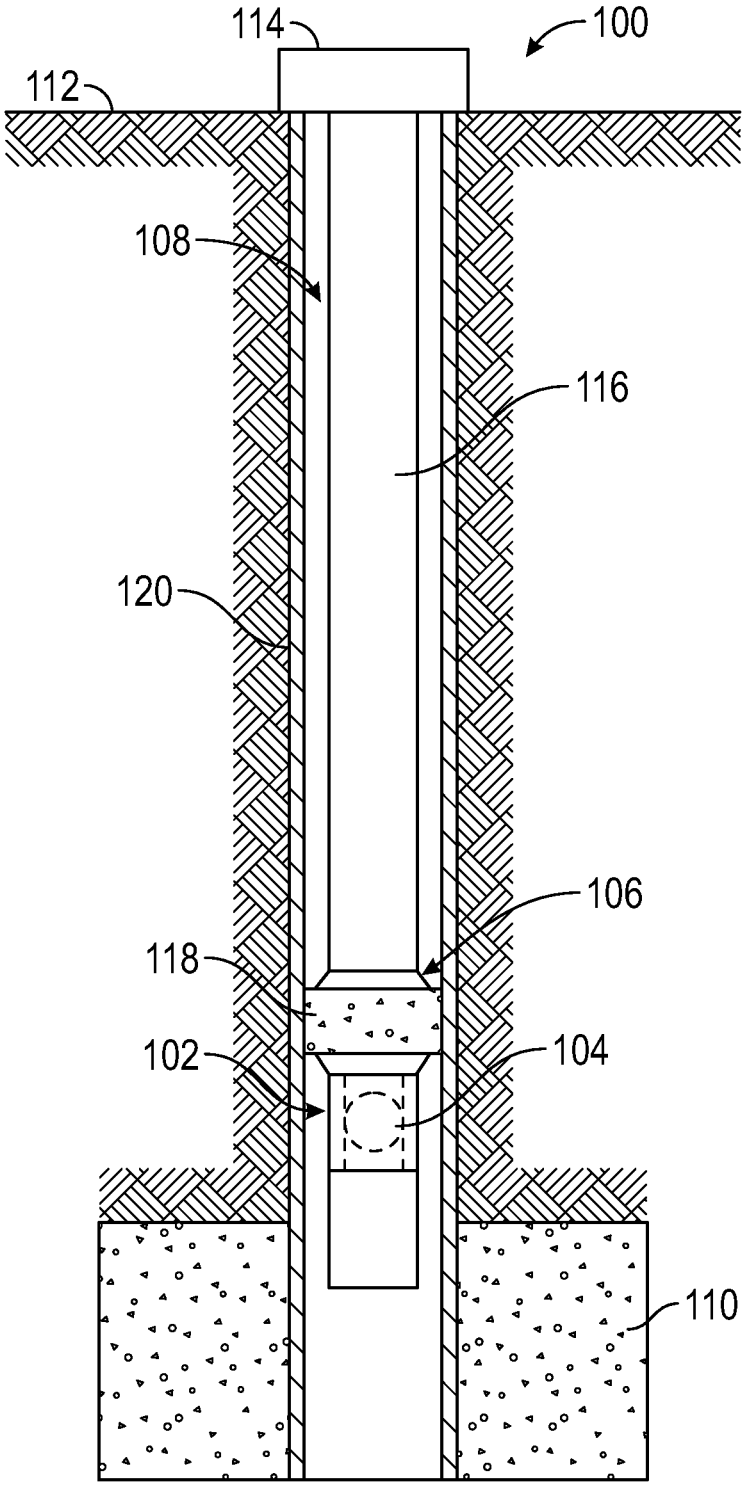
FIG. 1 shows a cross-sectional view of an example of a well string deployed in a wellbore and combined with an isolation valve, according to one or more embodiments of the present disclosure.

Referring generally to FIG. 1, an example of a well system 100 is illustrated as employing an isolation valve system 102 comprising at least one isolation valve 104. Well system 100 may comprise a completion 106 or other downhole equipment that is deployed downhole in a wellbore 108. The isolation valve 104 may be one of a wide variety of components included as downhole equipment 106. Generally, the wellbore 108 is drilled down into or through a formation 110 that may contain desirable fluids, such as hydrocarbon-based fluids. The wellbore 108 extends down from a surface location 112 beneath a wellhead 114 or other surface equipment suitable for the given application.

Depending on the specific well application, e.g., such as a well perforation application, the completion/well equipment 106 is delivered downhole via a suitable well string 116, e.g., a well completion string. However, the well string 116 and the components of completion 106 often vary substantially. In many applications, one or more packers 118 is used to isolate the annulus between downhole equipment 106 and the surrounding wellbore wall, which may be in the form of a liner or casing 120. The isolation valve 104 may be selectively actuated to open or isolate formation 110 with respect to flow of fluid through completion 106.

Figure 2:
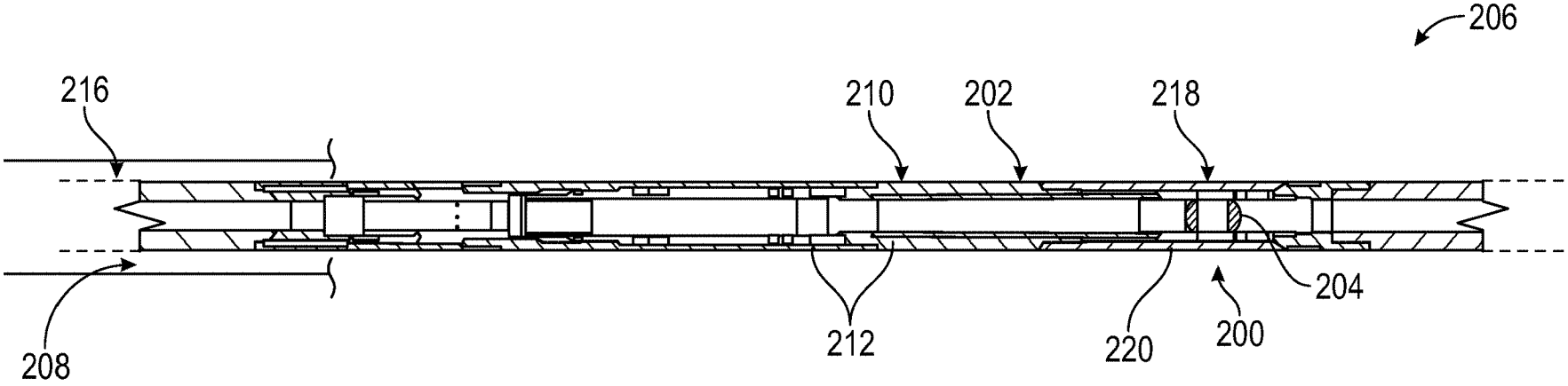
FIG. 2 shows a schematic view of a completion having an isolation valve deployed in a wellbore, according to one or more embodiments of the present disclosure.

Referring now to FIG. 2, an example of a completion 206 is illustrated. The completion 206 may include a well string 216 deployed in a wellbore 208 or other type of wellbore. The completion 206 also may include an actuatable device 200, which may be selectively actuated between operational positions via a shifting tool. For example, the shifting tool may be run down through well string 216 to actuate the actuatable device 200.

Still referring to FIG. 2, the actuatable device 200 according to one or more embodiments of the present disclosure may be part of an isolation valve 202 disposed along the well string 216. For example, the actuatable device 200 may be in the form of a ball valve element 204 or other type of actuatable valve element. According to the illustrated embodiment, the isolation valve 202 may include a ball section 218, which includes the ball valve element 204 rotatably mounted in a corresponding ball section housing 220. In one or more embodiments of the present disclosure, the ball valve element 204 may rotate open or closed with special seals to secure effective isolation along an interior of the well string 216 and to prevent entry of unwanted debris.

Still referring to FIG. 2, the ball valve element 204 (or other actuatable device) may be shifted between operational positions via a mechanical section 210 coupled with the ball section 218. According to one or more embodiments of the present disclosure, the mechanical section 210 may include a mechanical linkage 212 connected to the ball valve element 204 or other actuatable device. According to one or more embodiments of the present disclosure, the mechanical linkage 212 may include a mechanical shifting profile and a position-lock collet, for example. The mechanical section 210 and mechanical linkage 212 are operatively coupled with the shifting tool to shift the ball valve element 204.

Figure 3:
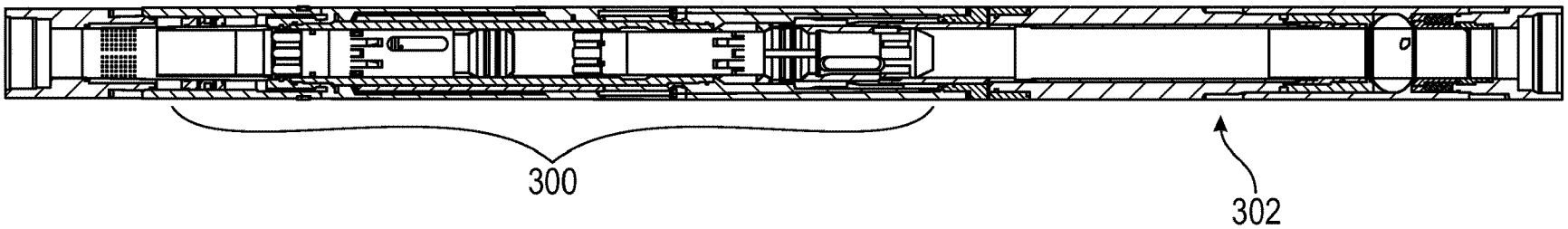
FIG. 3 shows a cross-sectional view of a shifting tool and an isolation valve, according to one or more embodiments of the present disclosure.

Turning now to FIG. 3, FIG. 3 is a cross-sectional view of a shifting tool 300 operable to open or close an isolation valve 302, a portion of which is not shown for clarity. In one embodiment, the isolation valve 302 may be a ball valve. In other embodiments, the isolation valve 302 may be a sleeve valve, a flapper valve, or any other type of isolation valve.

Figure 4:
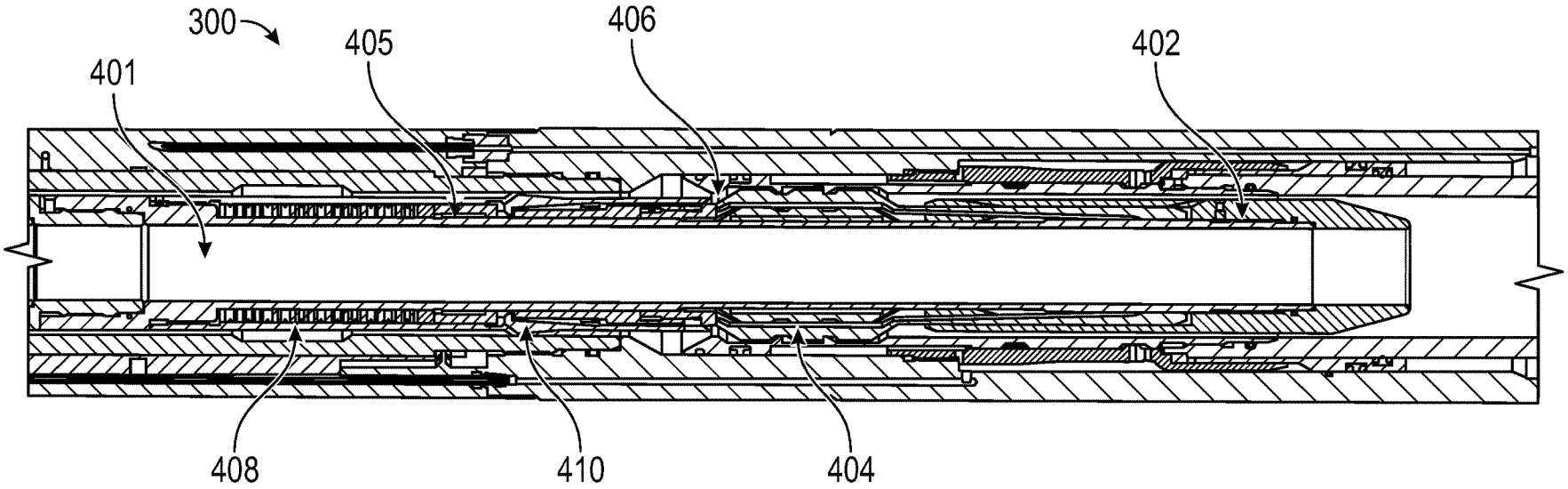
FIG. 4 shows a cross-sectional view of a portion of the shifting tool and the isolation valve of FIG. 3 in a first position.

Turning now to FIG. 4. FIG. 4 is a cross sectional view of a shifting section of the shifting tool 300 in a first position upon initial engagement with the isolation valve 302. The shifting tool 300 includes a mandrel 401 and shifting assembly 402 positioned about the mandrel 401 that includes a radially displaceable shifting member 404 and shifting piston 405. The shifting member 404 drifts restrictions in the drillstring as the shifting tool 300 is tripped into the wellbore and engages with a shifting profile 406 of the isolation valve 302. Force is transmitted from surface to the shifting member 404 through the shifting tool 300 via a sleeve 408 with a detent member 410. The sleeve 408 couples with the shifting piston 405 through the detent member 410. The shifting piston 405 transfers force to the shifting member 404 of the shifting tool 300 (which is connected to surface through drill pipe or another conveyance medium), thus generating a load-path between the surface and the isolation valve 302 that allows the isolation valve 302 to be shifted open or closed.

Figure 5:
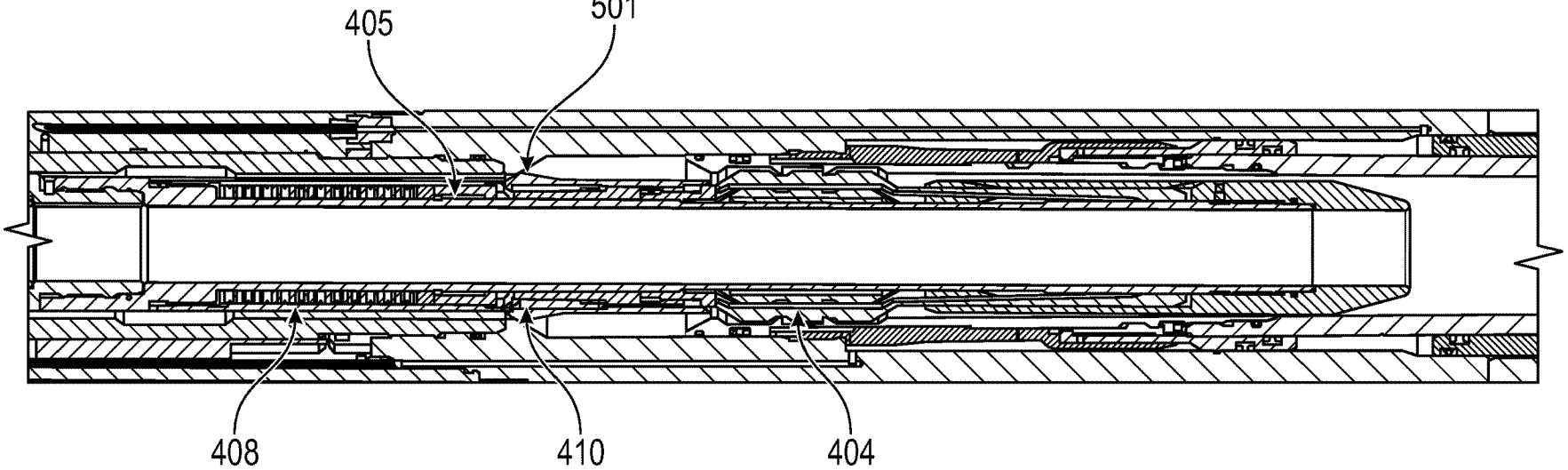
FIG. 5 shows a cross-sectional view of a portion of the shifting tool and the isolation valve of FIG. 3 in a second position.

Turning now to FIG. 5. FIG. 5 is a cross sectional view of the shifting tool 300 in a second position once it has reached the pre-determined location within the isolation valve corresponding to a successful shift. The detent member 410 of the sleeve 408 couples with the shifting piston 405 during the shift until a pre-determined location 501 in the isolation valve 302 is reached. This location may correspond to a fully shifted, i.e., a fully open or a fully closed, isolation valve 302. At the pre-determined location, the detent member 410 decouples from the shifting piston 405, thus allowing relative motion between the sleeve 408 and shifting member 404, as in FIG. 4.

Figure 6:
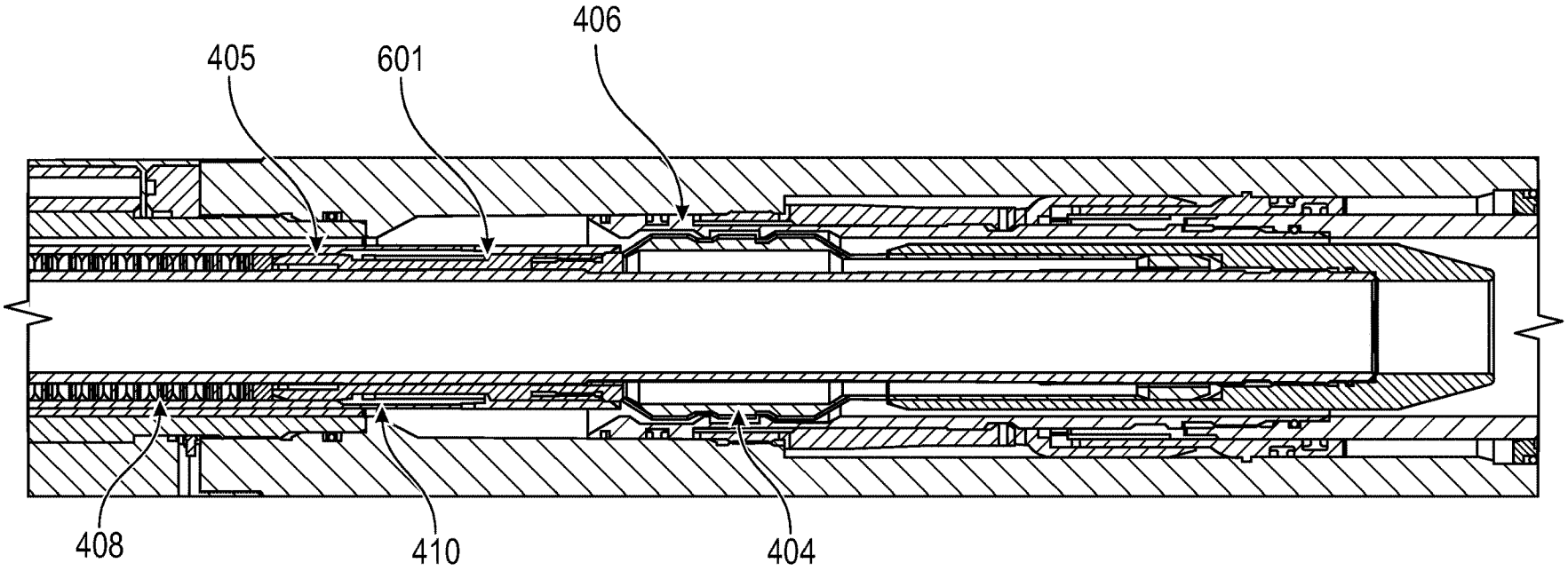
FIG. 6 shows a cross-sectional view of a portion of the shifting tool and the isolation valve of FIG. 3 in a third position.

Turning now to FIG. 6. FIG. 6 is a cross sectional view of the shifting tool 300 in a third position corresponding to the load-release position before the shifting member 404 releases from the isolation valve. After the detent member 410 decouples from the shifting piston 405, a second detent member 601 connected to the sleeve 408 couples the sleeve 408 to the shifting piston 405. This second detent member 601 allows a final pre-determined force to be delivered to the shifting member 404 before final decoupling. Once the pre-determined force is achieved, the second detent member 601 decouples from the shifting piston 405 and allows relative movement between the sleeve 408 and the shifting member 404.

Figure 7:
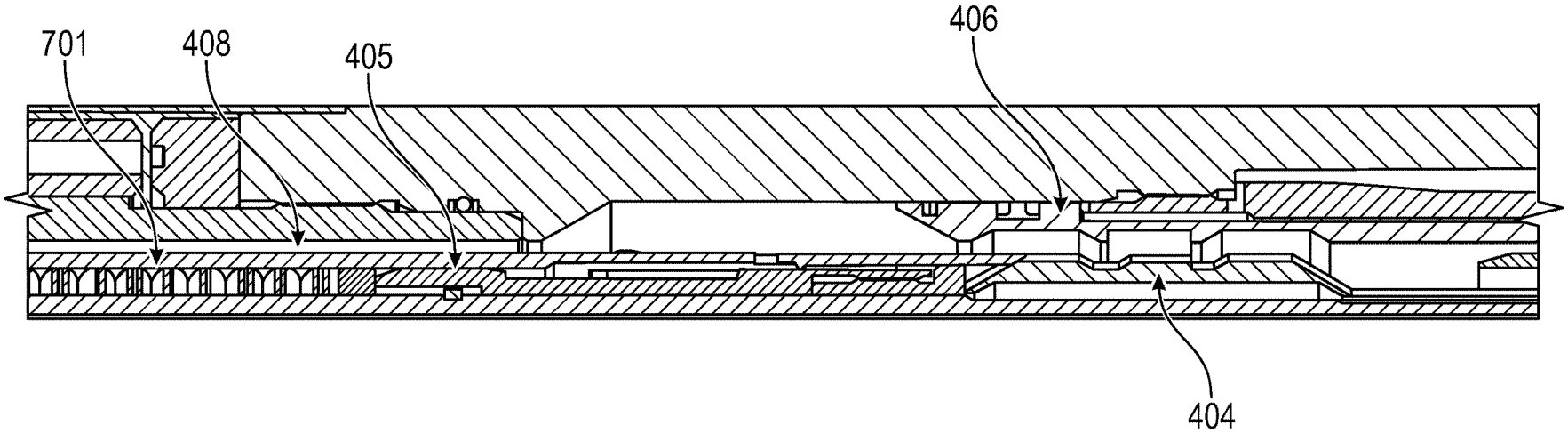
FIG. 7 shows a cross-sectional view of the shifting tool and the isolation valve of FIG. 3 in a fourth position.

Turning now to FIG. 7. FIG. 7 shows a cross sectional view of the shifting tool 300 in a fourth position corresponding to the shifting tool release from the isolation valve profile 406. The interfaces between the sleeve 408, the shifting piston 405, and the shifting member 404 are configured such that after the second detent member 601 decouples from the shifting piston 405, a force is applied to the shifting member 404 to deflect the shifting member 404 radially inward from the isolation valve 302. An additional force-release mechanism may be added to the shifting tool 300 to ensure the isolation valve 302 has been completely shifted. The force-release mechanism may activate after the positional-release mechanism and require a pre-determined force to be achieved before it releases. After the shifting tool 300 disengages from the isolation valve 302, the positional-release and the force-release mechanisms reset themselves through an energy storage device, such as a spring 701. After the mechanisms reset, the shifting tool 300 can be used to shift again or tripped out of the wellbore.

The shifting tool 300 may also contain an emergency release mechanism by which the load path between the shifting member 404 and the mandrel 401 via the sleeve 408 and shifting piston 405 is broken at a predetermined force, e.g., via a shear assembly, before the positional-release location is achieved. After the load path is broken, relative movement between the shifting member 404 and sleeve 408 is allowed, and the shifting member 404 is deflected out of the isolation valve 302. This mechanism may be used if the shifting tool 300 becomes stuck in the isolation valve 302 while pulling up (shifting the isolation valve 302 closed) and out of the hole.

Figure 8:
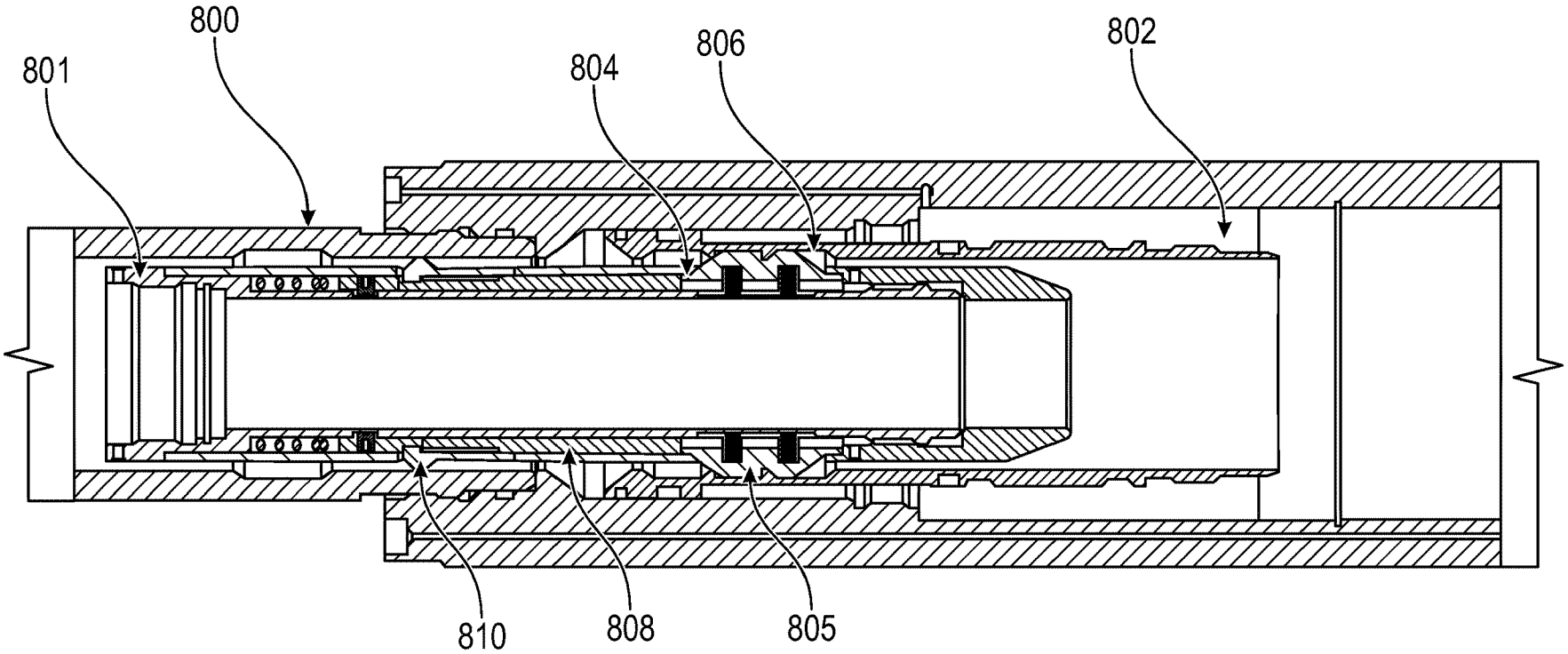
FIG. 8 shows a cross-sectional view of a shifting tool within a portion of an isolation valve in a first position, according to one or more embodiments of the present disclosure.

Turning now to FIG. 8, FIG. 8 is a cross-sectional view of a shifting tool 800 operable to open or close an isolation valve 802, a portion of which is not shown for clarity. In one embodiment, the isolation valve 802 may be a ball valve. In other embodiments, the isolation valve 802 may be a sleeve valve, a flapper valve, or any other type of isolation valve. The shifting tool 800 contains a mandrel 801 and shifting assembly positioned about the mandrel 801 that includes a radially displaceable shifting member 804 and biasing assembly 805, such as springs, that bias the shifting member 804 radially outward. The shifting member 804 drifts restrictions in the drillstring as the shifting tool 800 is tripped into the wellbore and engages with a shifting profile 806 of the isolation valve 802. Force is transmitted from surface to the shifting member 804 through the shifting tool 800 via a sleeve 808 with a detent member 810. The sleeve 808 connects the shifting member 804 to the shifting tool 800 (which is connected to surface through drill pipe or another conveyance medium) thus generating a load-path between the surface and the isolation valve 802 that allows the isolation valve 802 to be shifted open or closed.

Figure 9:
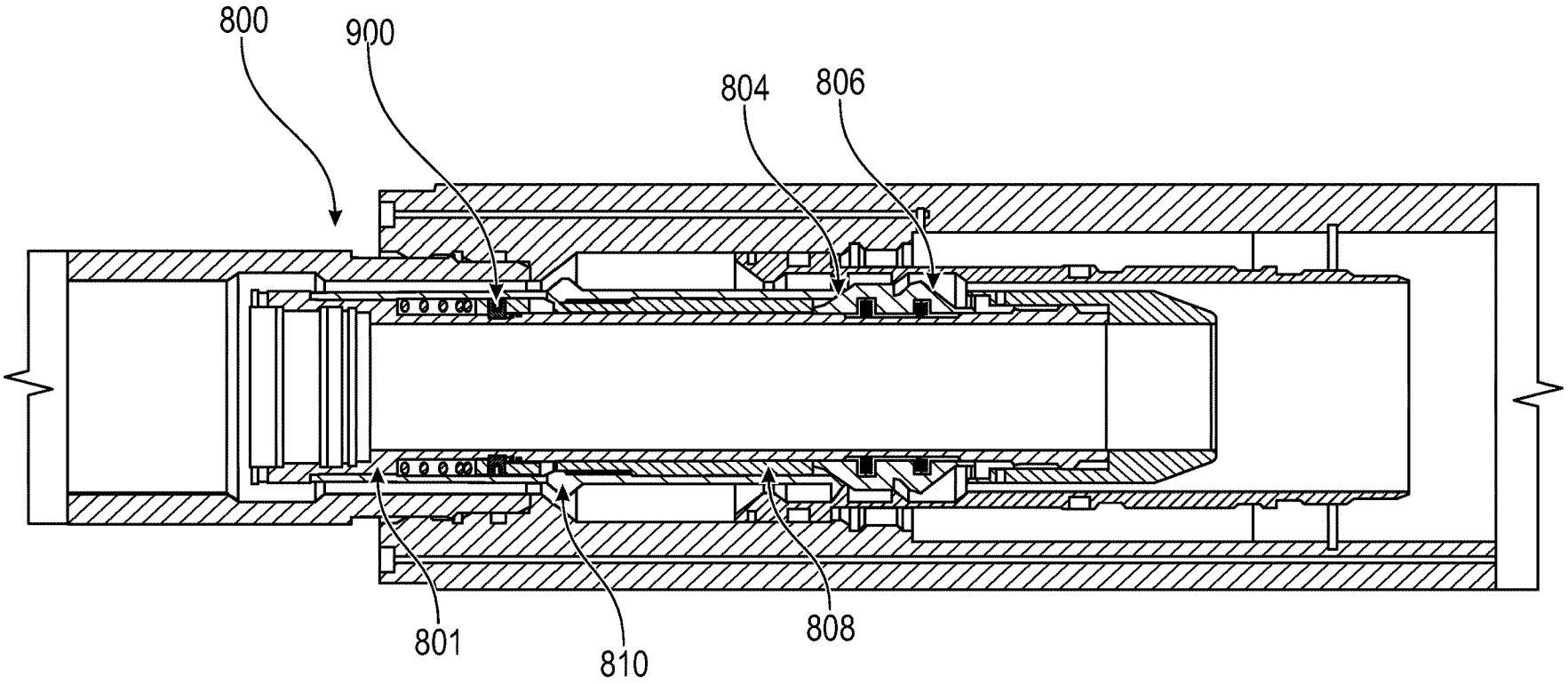
FIG. 9 shows a cross-sectional view of the shifting tool and the isolation valve of FIG. 8 in a second position.

The detent member 810 engages the sleeve 808 during the shift until a pre-determined location in the isolation valve 802 is reached, this location may correspond to a fully shifted, i.e., a fully open or a fully closed, isolation valve 802. At the pre-determined location, the detent member 810 disengages from the sleeve 808, thus allowing relative motion between the sleeve 808 and shifting member 804, as in FIG. 9. The interfaces between the sleeve 808, the detent member 810, and the shifting member 804 are configured such that a force is applied to the shifting member 804 to deflect the shifting member 804 radially inward from the isolation valve 802 profile as the sleeve 808 disengages from the shifting member 804. An additional force-release mechanism may be added to the shifting tool 800 to ensure the isolation valve 802 has been completely shifted. The force-release mechanism would activate after the positional-release mechanism and require a pre-determined force to be achieved before it releases. After the shifting tool 800 disengages from the IV, the positional-release and optional force-release mechanisms reset themselves through an energy storage device such as a spring. After the mechanisms reset, the shifting tool 800 can be used to shift again or tripped out of the wellbore.

The shifting tool 800 may also contain an emergency release mechanism by which the load path between the shifting member 804 and the mandrel 801 via the sleeve 808 is broken at a predetermined force, e.g., via a shear assembly 900, before the positional-release location is achieved. After the load path is broken, relative movement between the shifting member 804 and sleeve 808 is allowed, and the shifting member 804 is deflected out of the isolation valve 802 profile 806. This mechanism is necessary if the shifting tool 800 becomes stuck in the isolation valve 802 profile 806 while pulling up (shifting the isolation valve 802 close) and out of the hole.

Additionally, the shifting tool 800 may include a second shifting assembly. This assembly utilizes the same components as described above with reference to FIGS. 8 and 9; however, the second shifting assembly may be mirrored about the mandrel to allow the shifting tool 800 to be tripped further into the hole to engage the second shifting assembly and then pulled out of hole to shift the isolation valve 802 to the opposite position, e.g., from open to closed or from closed to open.

As used herein, a range that includes the term between is intended to include the upper and lower limits of the range; e.g., between 50 and 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A shifting tool for use with an isolation valve, the shifting tool comprising:

a mandrel; and a first shifting assembly positioned about the mandrel and comprising:

a first shifting member engageable with a profile of the isolation valve to shift the isolation valve into either an open position or a closed position;

a first sleeve engageable with the first shifting member to prevent disengagement between the first shifting member and the isolation valve;

a first detent mechanism engageable with the first shifting member to prevent disengagement between the first sleeve and the first shifting member; and wherein:

the first detent mechanism engages with the first shifting member when the shifting tool initially engages with the isolation valve; and relative movement of the shifting tool with respect to the isolation valve in a direction disengages the first detent mechanism from the first shifting member when the first detent mechanism reaches a predetermined location within the isolation valve.

2. The shifting tool of claim 1, wherein the shifting tool further comprises a second shifting assembly positioned about the mandrel.

3. The shifting tool of claim 2, wherein the second shifting assembly comprises:

a second shifting member engageable with the profile of the isolation valve to shift the isolation valve into the other of the open position or the closed position;

a second sleeve engageable with the second shifting member to prevent disengagement between the second shifting member and the isolation valve; and a second detent mechanism engageable with the second shifting member to prevent disengagement between the second sleeve and the second shifting member.

4. The shifting tool of claim 3, wherein the second shifting member, the second sleeve, and the second detent mechanism mirror the first shifting member, the first sleeve, and the first detent mechanism.

5. The shifting tool of claim 1, further comprising a biasing assembly that biases the shifting member radially outward.

6. The shifting tool of claim 5, wherein the biasing assembly comprises a spring.

7. The shifting tool of claim 1, further comprising a shear assembly coupling the first sleeve to the mandrel.

8. A completion system for use within a wellbore, the completion system comprising:

an isolation valve comprising an internal profile, the isolation valve positionable within the wellbore and shiftable between an open position and a closed position; and a shifting tool positionable within the wellbore and engageable with the isolation valve, the shifting tool comprising:

a mandrel; and a first shifting assembly positioned about the mandrel and comprising:

a first shifting member engageable with the internal profile to shift the isolation valve into either the open position or the closed position;

a first sleeve engageable with the first shifting member to prevent disengagement between the first shifting member and the isolation valve;

a first detent mechanism engageable with the first sleeve to prevent disengagement between the first sleeve and the first shifting member; and wherein:

the first detent mechanism engages with the first sleeve when the shifting tool initially engages with the isolation valve; and relative movement of the shifting tool with respect to the isolation valve in a direction disengages the first detent mechanism from the first sleeve when the first detent mechanism reaches a predetermined location within the isolation valve.

9. The completion system of claim 8, wherein the shifting tool further comprises a second shifting assembly positioned about the mandrel.

10. The completion system of claim 9, wherein the second shifting assembly comprises:

a second shifting member engageable with the internal profile of the isolation valve to shift the isolation valve into the other of the open position or the closed position;

a second sleeve engageable with the second shifting member to prevent disengagement between the second shifting member and the isolation valve; and a second detent mechanism engageable with the second shifting member to prevent disengagement between the second sleeve and the second shifting member.

11. The completion system of claim 10, wherein the second shifting member, the second sleeve, and the second detent mechanism mirror the first shifting member, the first sleeve, and the first detent mechanism.

12. The completion system of claim 8, further comprising a biasing assembly that biases the first shifting member radially outward.

13. The completion system of claim 12, wherein the biasing assembly comprises a spring.

14. The completion system of claim 8, further comprising a shear assembly coupling the first sleeve to the mandrel.

15. The completion system of claim 8, wherein the isolation valve is a ball valve or a flapper valve.

* * * * *